US009869528B2

(12) United States Patent
Pellett et al.

(10) Patent No.: US 9,869,528 B2
(45) Date of Patent: Jan. 16, 2018

(54) MICRO-POINTER SYSTEM FOR ARCHERY SIGHTS

(71) Applicant: FL Archery Holdings LLC, Superior, WI (US)

(72) Inventors: Aaron Pellett, Alborn, MN (US); Fred H. Hunt, Duluth, MN (US); Matthew Haas, Duluth, MN (US)

(73) Assignee: FeraDyne Outdoors, LLC, Superior, WI (US)

( * ) Notice: Subject to any disclaimer, the term of this patent is extended or adjusted under 35 U.S.C. 154(b) by 149 days.

(21) Appl. No.: 14/987,068

(22) Filed: Jan. 4, 2016

(65) Prior Publication Data

US 2016/0231086 A1 Aug. 11, 2016

Related U.S. Application Data

(60) Provisional application No. 62/112,333, filed on Feb. 5, 2015.

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265
See application file for complete search history.

(56) References Cited

U.S. PATENT DOCUMENTS 3,097,432 A 7/1963 Shaw
3,470,616 A 10/1969 Thompson
3,693,262 A 9/1972 Wood
4,020,560 A * 5/1977 Heck ..... F41G 1/16 33/265
4,400,887 A 8/1983 Mason
4,417,403 A 11/1983 Strange
4,473,959 A 10/1984 Saltzman
4,625,421 A 12/1986 Strauss
4,764,011 A 8/1988 Goldstein
4,928,394 A 5/1990 Sherman
5,025,565 A 6/1991 Stenerson et al.
5,080,084 A 1/1992 Kendall et al.
5,121,547 A 6/1992 Littlejohn
5,152,068 A 10/1992 Meister et al.
5,157,839 A 10/1992 Beutler
5,168,631 A 12/1992 Sherman
5,201,124 A 4/1993 Sherman
5,231,765 A 8/1993 Sherman
5,303,479 A 4/1994 Rudovsky
5,308,986 A 5/1994 Walker
5,338,037 A 8/1994 Toyohara
5,384,966 A 1/1995 Gibbs
(Continued)

OTHER PUBLICATIONS

Vital Gear 2007 Product Catalog.

*Primary Examiner* — Christopher Fulton
(74) *Attorney, Agent, or Firm* — Winthrop & Weinstine, P.A.

(57) ABSTRACT

A micro-pointer system coupled to a primary pointer system on a target or hunting sight. The primary pointer system includes a primary pointer attached to the micro-pointer system to provide an indication of an elevation setting. The micro-pointer system employs a micro-adjust mechanism that simultaneously displaces a micro-pointer and a primary pointer in an accurate and repeatable manner in relation to respective scales on the body of the sight.

19 Claims, 8 Drawing Sheets

(56) References Cited

U.S. PATENT DOCUMENTS

| | | | | |
|---|---|---|---|---|
| 5,420,959 | A | 5/1995 | Walker et al. | |
| 5,428,901 | A | 7/1995 | Slates | |
| 5,442,861 | A | 8/1995 | Lorocco | |
| 5,560,113 | A | 10/1996 | Simo et al. | |
| 5,606,638 | A | 2/1997 | Tymianski et al. | |
| 5,638,604 | A | 6/1997 | Lorocco | |
| 5,649,526 | A | 7/1997 | Ellig | |
| 5,650,884 | A | 7/1997 | Sasaki et al. | |
| 5,685,081 | A | 11/1997 | Winegar | |
| 5,694,713 | A | 12/1997 | Paldino | |
| 5,764,410 | A | 6/1998 | Jibiki | |
| 5,850,700 | A | 12/1998 | Capson et al. | |
| 5,862,603 | A | 1/1999 | Ellig | |
| RE36,266 | E | 8/1999 | Gibbs | |
| 5,956,854 | A | 9/1999 | Lorocco | |
| 5,964,713 | A | 10/1999 | Nomura et al. | |
| 6,000,141 | A | 12/1999 | Afshari | |
| 6,016,608 | A | 1/2000 | Lorocco | |
| 6,024,079 | A | 2/2000 | Ingle et al. | |
| 6,082,012 | A | 7/2000 | McLeod | |
| 6,122,833 | A | 9/2000 | Lorocco | |
| 6,191,574 | B1 | 2/2001 | Dilger | |
| 6,216,352 | B1 | 4/2001 | Lorocco | |
| 6,311,405 | B1 | 11/2001 | Slates | |
| 6,360,472 | B1 | 3/2002 | Lorocco | |
| 6,385,855 | B1 | 5/2002 | Tymianski | |
| 6,421,946 | B1 | 7/2002 | Lorocco | |
| 6,477,778 | B1 | 11/2002 | Lorocco | |
| 6,477,780 | B2 | 11/2002 | Aldred | |
| 6,557,291 | B2 | 5/2003 | Hoadley | |
| 6,560,884 | B1 | 5/2003 | Afshari | |
| 6,564,462 | B1 | 5/2003 | Henry | |
| 6,571,482 | B1 | 6/2003 | Tymianski | |
| 6,581,317 | B1 | 6/2003 | Slates | |
| 6,634,110 | B2 | 10/2003 | Johnson | |
| 6,634,111 | B2 | 10/2003 | LoRocco | |
| 6,725,854 | B1 | 4/2004 | Afshari | |
| 6,796,037 | B1 | 9/2004 | Geffers et al. | |
| 6,802,129 | B1 | 10/2004 | Wirth | |
| 6,817,105 | B2 | 11/2004 | LoRocco | |
| 6,925,721 | B2 | 8/2005 | Dietz | |
| 6,938,349 | B2 | 9/2005 | Afshari | |
| 6,964,105 | B2 | 11/2005 | McLeod | |
| 6,981,329 | B1 | 1/2006 | Strathman | |
| 7,036,234 | B2 | 5/2006 | Rager | |
| 7,200,943 | B2 | 4/2007 | Afshari | |
| 7,278,216 | B2 | 10/2007 | Grace | |
| 7,290,345 | B2 | 11/2007 | Ellig | |
| 7,308,891 | B2 | 12/2007 | Graf | |
| 7,331,112 | B2 | 2/2008 | Gibbs | |
| 7,343,686 | B2 | 3/2008 | Rager | |
| 7,360,313 | B1 | 4/2008 | Hamm et al. | |
| 7,461,460 | B2 | 12/2008 | Priebe | |
| 7,464,477 | B2 | 12/2008 | Afshari | |
| 7,503,122 | B2 | 3/2009 | Afshari | |
| 7,503,321 | B2 | 3/2009 | Afshari | |
| 7,562,486 | B2 | 7/2009 | LoRocco | |
| 7,574,810 | B1 | 8/2009 | LoRocco | |
| 7,574,811 | B2 | 8/2009 | Kurtzhals et al. | |
| 7,610,686 | B1 * | 11/2009 | Summers | F41G 1/467 124/87 |
| 7,739,825 | B2 | 6/2010 | LoRocco | |
| 7,814,668 | B1 | 10/2010 | Pulkrabek et al. | |
| 7,832,109 | B2 | 11/2010 | Gibbs et al. | |
| 7,900,365 | B1 | 3/2011 | Johnson | |
| 7,921,570 | B1 | 4/2011 | Pulkrabek et al. | |
| 7,958,643 | B1 | 6/2011 | Wu | |
| 8,006,395 | B2 | 8/2011 | Kingsbury | |
| 8,079,153 | B2 | 12/2011 | Pulkrabek et al. | |
| 8,186,068 | B2 | 5/2012 | Pulkrabek et al. | |
| 8,689,454 | B2 | 4/2014 | Pulkrabek et al. | |
| 8,739,419 | B1 * | 6/2014 | Pulkrabek | F41G 1/467 124/87 |
| 8,839,525 | B2 * | 9/2014 | Pulkrabek | F41G 1/467 124/87 |
| 9,441,913 | B1 * | 9/2016 | Donahoe | F41G 1/467 |
| 9,518,803 | B2 * | 12/2016 | Wassmer | F41G 1/467 |
| 9,587,912 | B2 * | 3/2017 | Pulkrabek | F41B 5/14 |
| 2002/0073560 | A1 | 6/2002 | LoRocco | |
| 2003/0056379 | A1 | 3/2003 | Johnson et al. | |
| 2003/0110647 | A1 | 6/2003 | Henry | |
| 2004/0107587 | A1 | 6/2004 | Floied et al. | |
| 2004/0111900 | A1 | 6/2004 | Rager | |
| 2005/0132588 | A1 | 6/2005 | McLeod | |
| 2005/0193575 | A1 | 9/2005 | Springer et al. | |
| 2005/0235503 | A1 | 10/2005 | Afshari | |
| 2006/0254065 | A1 | 11/2006 | Grace | |
| 2007/0028467 | A1 | 2/2007 | Bradley et al. | |
| 2007/0163131 | A1 | 7/2007 | Gibbs | |
| 2009/0000134 | A1 | 1/2009 | Kurtzhals et al. | |
| 2009/0199418 | A1 | 8/2009 | LoRocco | |
| 2009/0235540 | A1 | 9/2009 | Rager | |
| 2009/0293855 | A1 | 12/2009 | Danielson et al. | |
| 2010/0258628 | A1 | 10/2010 | Bay | |
| 2011/0167654 | A1 | 7/2011 | Pulkrabek et al. | |
| 2011/0186028 | A1 | 8/2011 | VandeWater | |
| 2011/0214304 | A1 | 9/2011 | Priebe | |
| 2011/0252654 | A1 | 10/2011 | Edmundson | |
| 2011/0277329 | A1 | 11/2011 | Summers et al. | |
| 2012/0102767 | A1 | 5/2012 | Pulkrabek et al. | |
| 2012/0180329 | A1 | 7/2012 | Priebe | |
| 2012/0255187 | A1 | 10/2012 | Sims et al. | |
| 2012/0297659 | A1 | 11/2012 | Lattimer | |
| 2012/0325194 | A1 | 12/2012 | LoRocco | |
| 2013/0118019 | A1 | 5/2013 | Kingsbury et al. | |
| 2013/0174430 | A1 | 7/2013 | Pulkrabek et al. | |
| 2013/0174431 | A1 | 7/2013 | Pulkrabek et al. | |
| 2013/0242593 | A1 | 9/2013 | LoRocco et al. | |
| 2013/0269668 | A1 | 10/2013 | Hunt | |
| 2014/0014082 | A1 | 1/2014 | Hunt | |

* cited by examiner

MICRO-POINTER SYSTEM FOR ARCHERY SIGHTS

CROSS-REFERENCE TO RELATED APPLICATION

This application claims the benefit under 35 U.S.C. § 119(e) of U.S. Provisional Patent Application No. 62/112,333, filed Feb. 5, 2015, which is herein incorporated by reference in its entirety.

FIELD OF EMBODIMENTS OF THE INVENTION

The present disclosure is directed to a pointer system that includes a micro-pointer system coupled to a primary pointer system on a target or hunting sight. The micro-pointer system includes a micro-adjust mechanism that simultaneously displaces a micro-pointer and a primary pointer in an accurate and repeatable manner in relation to respective scales on the body of the sight.

BACKGROUND OF EMBODIMENTS OF THE INVENTION

FIG. 1 is a perspective view of a compound bow 28 with a known bow sight 20 that has an elevation assembly 22 and windage assembly 32. Elevation assembly 22 permits a shooter to raise and lower the bezel 24 relative to bow 28 (and string 60) along vertical axis 26 to compensate for distance to the target. Windage assembly 32 permits the shooter to move the bezel 24 along horizontal axis 34 to compensate for wind conditions. As used herein, references to "X-axis," "Y-axis," or "Z-axis" relate to an orthogonal coordinate system that is used to describe the relative position of features on the bow 28 and the bow sight 20, and not necessarily related to absolute vertical or horizontal unless otherwise stated.

FIG. 2 is a perspective view of a pointer system 70 for a multi-axis bow sight 38. FIG. 3 is a perspective view of the opposite side of the bow sight of FIG. 2. FIGS. 2 and 3 are illustrative of a bow sight 38, such as disclosed in U.S. Pat. Nos. 7,331,112, 7,832,109, 8,689,454, 8,739,419, and 8,839,525, each of which are hereby incorporated by reference. Elevation assembly 40 includes elevation block 44 attached to mounting assembly 42. The elevation block 44 includes a finely threaded lead screw 46 configured to move bezel traveler 48 along Z-axis 50. Knobs 52 are located at the top and bottom of the elevation block 44 to facilitate rotation of the lead screw 46. Guide pin 54 stabilizes the bezel traveler 48 during movement along the Z-axis 50.

Bezel assembly 56 is attached to the bezel traveler 48. In the illustrated embodiment, the bezel assembly 56 includes a single sight pin 58. With regard to FIG. 1, sight pin 58 is generally aligned with the side of the string 60 when the bow 28 is at full draw.

Pointer system 70 attached to the bezel assembly 56 provides an indication of the elevation setting of the elevation assembly 40. In the illustrated embodiment, pointer system 70 includes pointer 72 that moves with the bezel assembly 56 along scale 74 that is engraved or adhered to the bow sight 38, such as along the elevation block 44. The bow sight 38 includes a pointer system 70 on both sides of the elevation block 44. The scale 74 typically does not reflect yardage, but rather, corresponds to rotation of the lead screw 46. The numbers or indicia on the scale 74 can be converted using a chart or handheld computer application to the yardage an arrow is likely to travel. Generally on the opposite side of the bow sight 38 there is a secondary scale that people hand write in yardage marks, or print them on a computer and tape them down.

In the embodiment of FIG. 3, the pointer 72 indicates that the elevation of the bow sight 38 is adjusted for number 75 on the scale 74 (e.g., 50 yards). In theory, if the archer aligns the tip 76 of the sight pin 58 on a target located at a distance corresponding to number 75 on the scale 74 (e.g., 50 yards), the arrow should strike the center of the target.

As shooting parameters change, however, this pointer must be adjusted in order to accurately reflect where the arrow will strike. As used herein, "shooting parameters" refers to one or more variables that alter the distance the arrow will travel, such as, for example, temperature, humidity, air pressure, arrow weight, draw weight, shaft stiffness, shaft length, arrow tip configuration, and shooting angle (uphill or downhill).

With regard to a change in arrow weight, if the bezel assembly 54 is not moved relative to the sight 38, a heavier arrow will travel less than the distance that corresponds with number 75 on the scale 74. In this example, indicia 75 on the scale 74 corresponds to 50 yards. If a lighter arrow is used, it will travel more than the distance that corresponds with number 75 on the scale 74. Consequently, the pointer system 70 must be adjusted so the pointer 72 indicates the correct yardage for the applicable shooting parameters.

In another example, an archer zeroes-in the sight 38 for a particular distance (e.g., 50 yards). Due to a particular shooting parameter or some variability in the sight 38, the pointer 72 may not be aligned with the location on the scale 74 that corresponds with 50 yards. Again, the archer needs to adjust the pointer 72 so that the indicated yardage corresponds to the current shooting parameters.

Traditionally, pointer systems are held to the bow sight 38 with a screw or clamp mechanism. As illustrated in FIGS. 2 and 3, the pointer 72 is held to the bow sight 38 by fastener 80. Slot 82 in the pointer 72 provides a limited range of adjustment. The archer loosens the fastener 80 and delicately slides the pointer 72 up or down to reflect the correct yardage for the current shooting conductions. Often times the pointer moves too much or too little, or completely falls off of the sight, leaving the archer with a difficult time re-establishing the sight's zero. In other circumstances, the available adjustment in the pointer 72 is not sufficient to make the necessary adjustment.

SUMMARY OF EMBODIMENTS OF THE INVENTION

Embodiments of the present invention are directed to a pointer system that includes a micro-pointer system coupled to a primary pointer system on a target or hunting sight. The micro-pointer system includes a micro-adjust mechanism that simultaneously displaces a micro-pointer and a primary pointer in an accurate and repeatable manner in relation to respective scales on the body of the sight.

In a preferred embodiment, the micro-pointer rides in a slot and is threaded for a micro-adjust pointer lead screw. The lead screw is driven by a micro adjust knob. Other micro-adjust mechanisms can also be used, such as for example, a rack-and-pinion system, cam systems, linkage systems with elongated lever arms, and the like.

In use, a shooter loosens the locking screw on the body of the sight and turns the micro-adjust knob. In an embodiment, the lead screw preferably drives the carriage 0.025" for every revolution of the knob. When the micro-pointer is adjusted the appropriate amount to bring the arrow grouping back to center, the shooter tightens the locking screw and returns to shooting. For micro-pointer adjustments that are larger than the available travel, both locking screws can be loosened and the primary pointer can be slid the appropriate amount, or one screw can be loosened at a time and the primary pointer in can be moved in stages using the micro-adjust knob.

A mounting arm is utilized, configured to attach the pointer system to a bow. An elevation assembly is attached to the mounting arm. The elevation assembly includes an elevation adjustment mechanism that moves a bezel mount along a generally vertical axis relative to the mounting arm. A bezel is attached to the bezel mount. The bezel includes at least one sighting device to sight the bow at a target. A micro-pointer system is attached to the bezel mount that travels with the bezel mount along the vertical axis. The micro-pointer system includes a micro-adjust mechanism configured to move a micro-pointer parallel to the vertical axis relative to a micro-scale on the bezel mount. A primary pointer system including a primary pointer is attached to the micro-pointer to provide an indication of an elevation setting of the elevation assembly relative to the mounting arm along a primary scale located on the elevation adjustment mechanism, so adjustment of the micro-adjust mechanism simultaneously moves the primary pointer relative to the primary scale and the micro-pointer relative to the micro-scale.

The micro-adjust mechanism preferably repeatably displaces the micro-pointer in increments of about 0.05 inches, and more preferably about 0.025 inches. In one embodiment, the micro-adjust mechanism includes a micro-adjust lead screw that spans a recess in the bezel mount, with the micro-pointer located within the recess. Rotation of micro-adjust lead screw about 360 degrees results in displacement of the micro-pointer and the primary pointer of about 0.025 inches along the vertical axis.

In one embodiment, the indicia on the micro-scale are the same units of measure as indicia on the primary scale. In another embodiment, the indicia on the micro-scale include an indication of an adjustment required for a shooting parameter other than distance to the target. For example, the indicia on the micro-scale may be an indication of an adjustment required for different arrow weights, different shooting angles, and the like.

In another embodiment, the pointer system for an archery sight includes an elevation block with an elevation lead screw engaged with a threaded bezel mount to move the bezel mount along a generally vertical axis relative to the mounting arm in response to rotation of the elevation lead screw. A bezel including at least one sighting device to sight the bow at a target is attached to the bezel mount. A micro-pointer system is attached to the bezel mount that travels with the bezel mount along the vertical axis in response to rotation of the elevation lead screw. The micro-pointer system includes a micro-adjust lead screw configured to move a threaded micro-pointer parallel to the vertical axis relative to a micro-scale on the bezel mount in response to rotation of the micro-adjust lead screw. A primary pointer system including a primary pointer is attached to the micro-pointer to provide an indication of an elevation setting of the elevation assembly relative to the mounting arm along a primary scale located on the elevation block. Rotation of the micro-adjust lead screw simultaneously moves the primary pointer relative to the primary scale and the micro pointer relative to the micro-scale.

Embodiments are also directed to methods for operating a pointer system on an archery sight that is mounted to a bow. The method includes adjusting a vertical position of a sighting device attached to the bezel mount relative to the vertical axis so an arrow fired from the bow strikes a target located at a first distance from the archer at a location indicated by the sighting device. A micro-adjust mechanism is adjusted so the primary pointer is aligned with an indicia on the primary scale corresponding to the first distance.

DESCRIPTION OF EMBODIMENTS OF THE INVENTION

Figure 1:
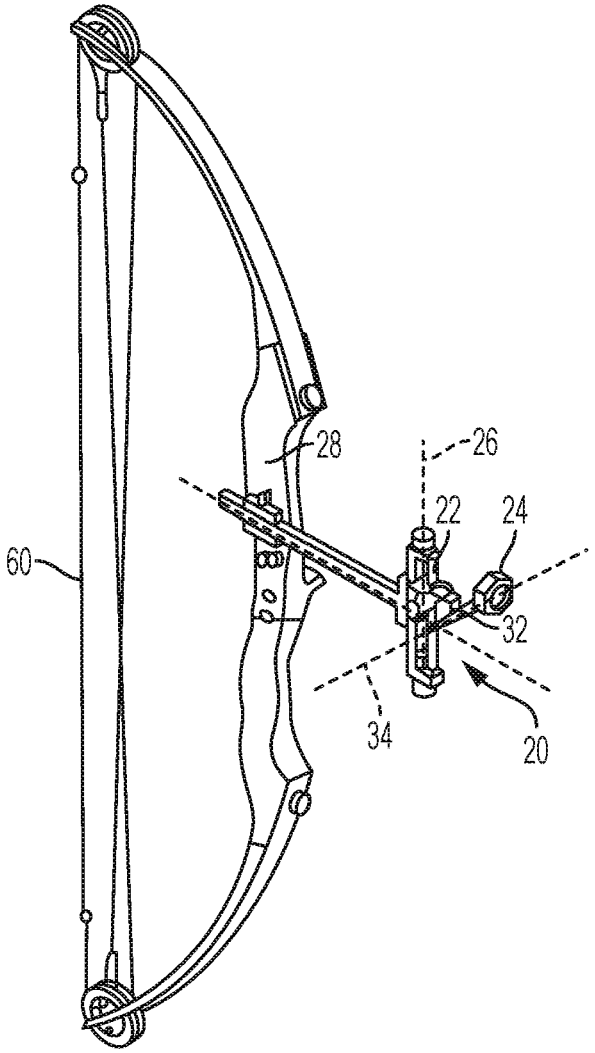
FIG. 1 (PRIOR ART)
FIG. 1 is a perspective view of a compound bow with a prior art elevation assembly and windage assembly.
Figure 2:
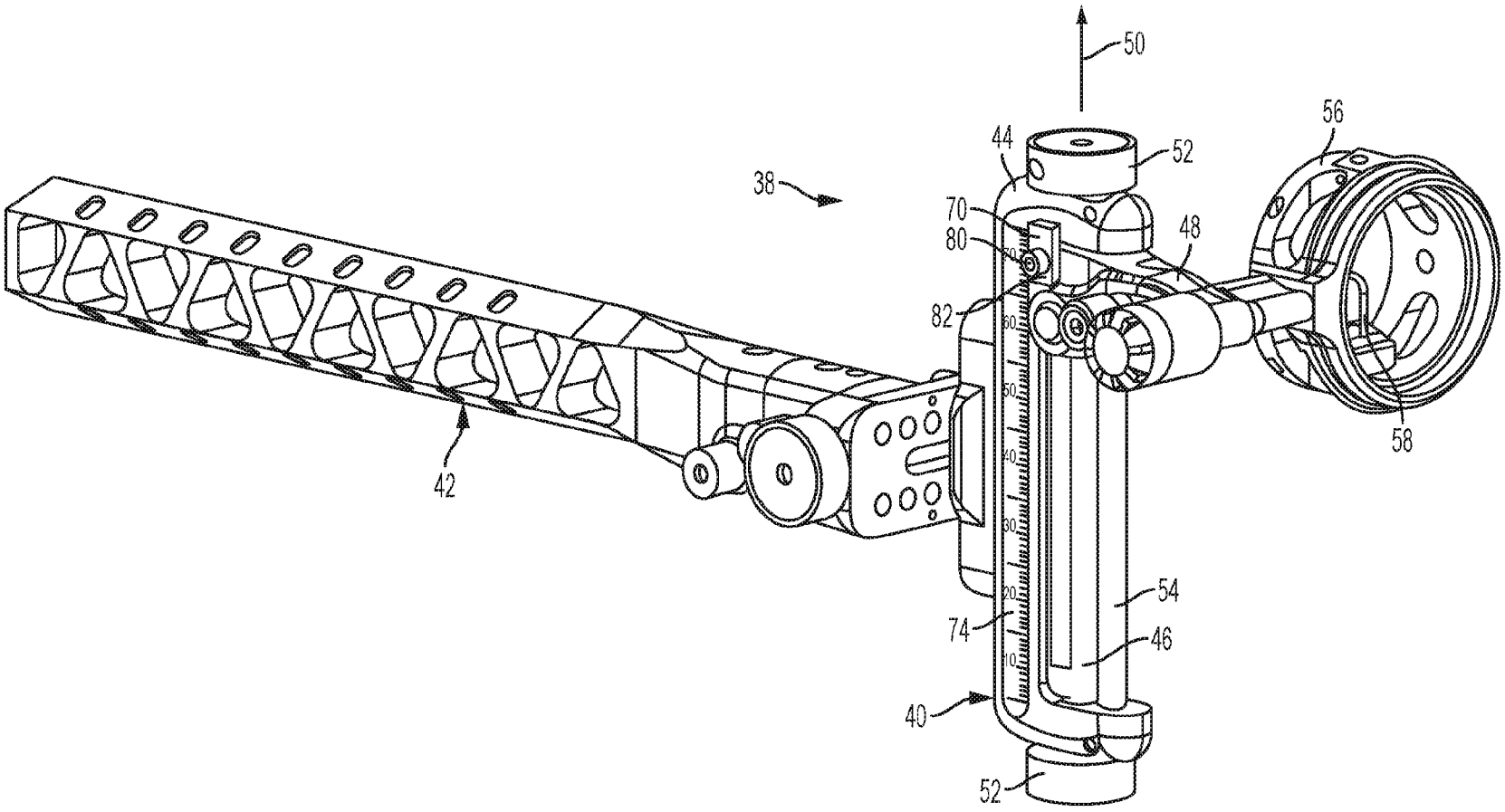
FIG. 2 (PRIOR ART)
FIG. 2 is a perspective view of a conventional pointer system for a multi-axis bow sight.
Figure 3:
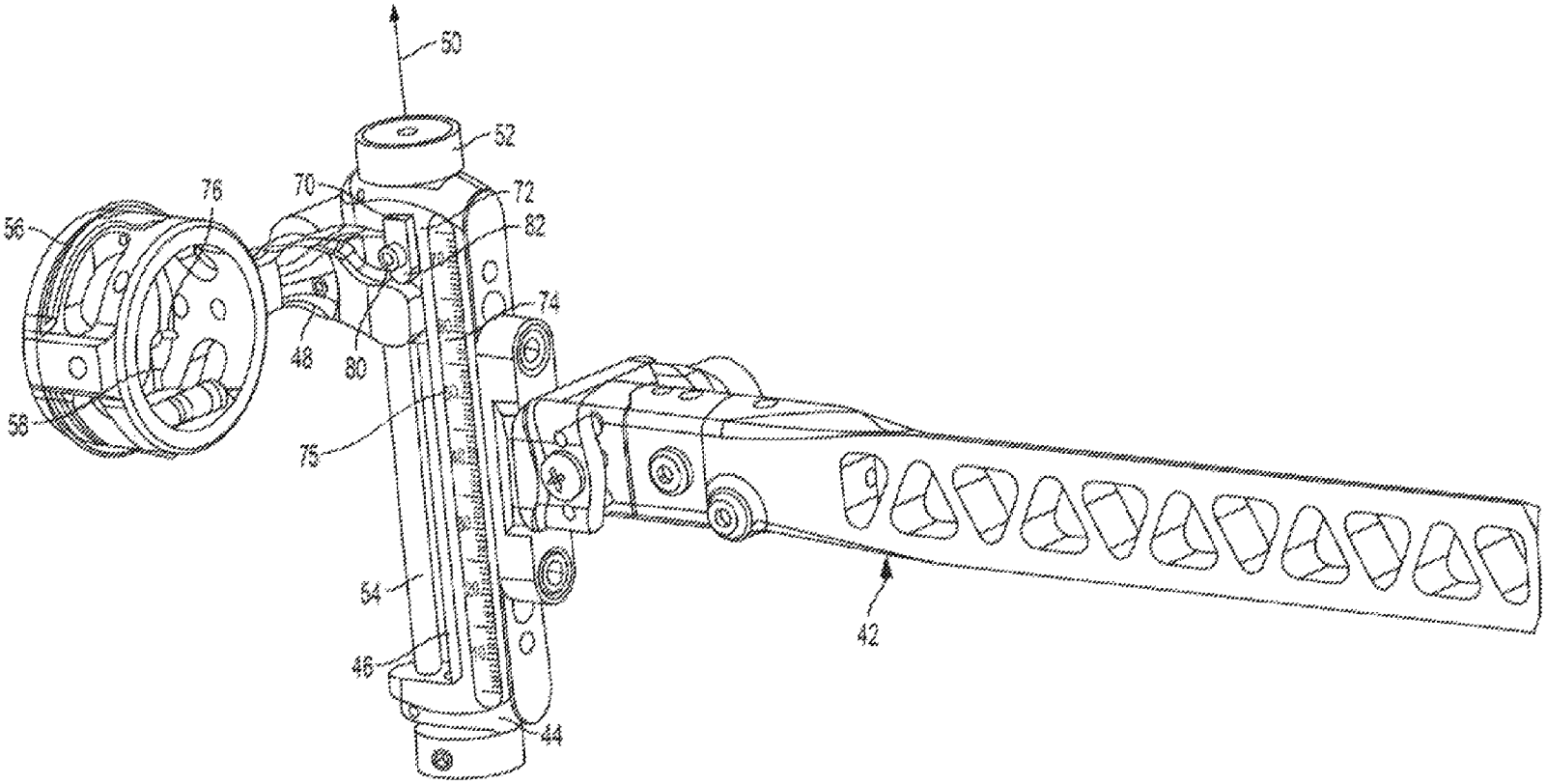
FIG. 3 (PRIOR ART)
FIG. 3 is a perspective view of the opposite side of the bow sight of FIG. 2.

FIGS. 4 through 7 illustrate a multi-axis bow sight 100 with micro-pointer system 102 in accordance with an embodiment of the present disclosure. The bow sight 100 includes elevation assembly 104 with elevation block 106 attached to mounting arm 108 that attaches to a bow. In the illustrated embodiment, the elevation block 106 includes a finely threaded lead screw 110 configured to move bezel mount 112 along Z-axis 50. Knobs 114 are located at the top and bottom of the elevation block 106 to facilitate rotation of the lead screw 110. Guide pin 116 stabilizes the bezel mount 112 during movement along the Z-axis 50. The bow sight 100 is illustrated without a bezel (see e.g., FIGS. 2 and 3) and can be used with a variety of bezels and sight pin configurations. Other elevation adjustment mechanism are also used with bow sights, such as for example, rack-and-pinion system, cam systems, linkage systems with elongated lever arms, and the like.

Figure 6:
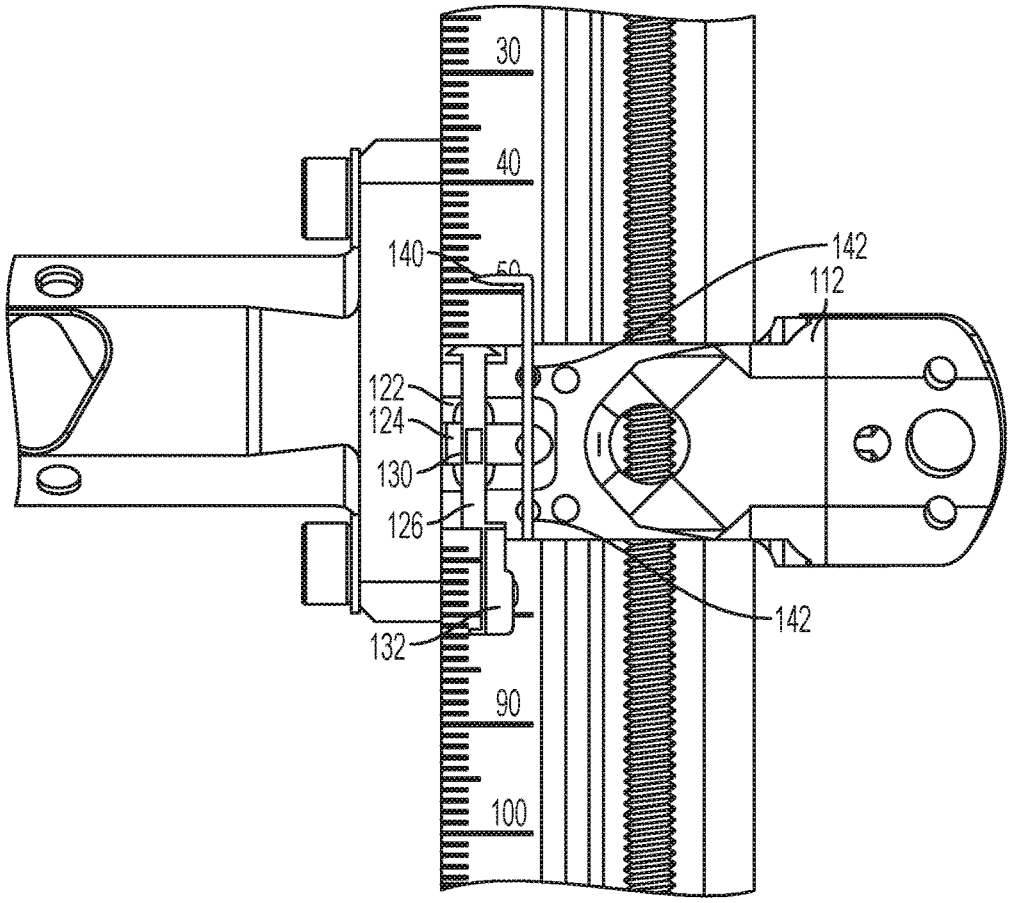
FIG. 6 is a sectional view of the micro-pointer system of FIG. 4.

Micro-pointer system 102 is attached to the bezel mount 112 in recess 122. In the illustrated embodiment, micro-pointer 124 is suspended within the recess 122 by lead screw 126. As illustrated in FIG. 6, the micro-pointer 124 includes threaded region 130 that engages with the lead screw 126. Knob 132 facilitates rotation of the lead screw 126 and moves the micro-pointer 124 parallel to the z-axis 50 within the recess 122. The bezel assembly 120 includes micro-scale 128 adjacent to the recess 122 with exemplary indicia 150, 152, 154 that provide an indication of the movement of the micro-pointer 124 relative to the bezel mount 112.

As used herein, "micro-adjust mechanism" refers to a repeatable and accurate system for displacing the micro-pointer in increments of about 0.05 inches, and more preferably, increments of about 0.025 inches. For example, in one embodiment the threads of the lead screw 126 have a pitch so that about a 360 degree rotation of the lead screw 126 results in linear translation of the micro-pointer 124 about 0.025 inches. It will be appreciated that precise movement of the micro-pointer 124 can be achieved by a variety of other mechanisms, such as for example a rack-and-pinion system, cam systems, linkage systems with elongated lever arms, and the like. Examples of these alternate adjustment mechanisms are disclosed in U.S. Pat. Nos. 6,802,129, 5,539,989, and 7,584,543, each of which are hereby incorporated by reference.

Primary pointer 140 is preferably attached to the micro-pointer 124 so that adjustment of the micro-pointer 124 is translated to the primary pointer 140. In the illustrated embodiment, the primary pointer 140 slides in holes 142 in the bezel mount 112 (see FIG. 6) and is held in place by set screw 143. Set screw 143 can be loosened to adjust the position of the primary pointer 140 relative to the micro-pointer 124.

The indicia 146, 150, 152, 154 on the micro-scale 128 and the primary scale 144 are typically arbitrary units that can be correlated to yardage using a chart or handheld computer application. In one embodiment, the indicia 150, 152, 154 on the micro-scale 128 comprises the same units of measure as the indicia 146 on the primary scale 144. For example, the micro-scale 128 can provide +/− indications of yardage (i.e., distance the arrow will travel) relative to the yardage indicated on the primary scale 144. Adjustments shown on the micro-scale 128 can be added or subtracted from the value shown on primary scale 144, as applicable, to determine with variation between the distance indicated by the primary pointer 140 and the actual distance the arrow will travel for a given set of shooting parameters.

In operation, the archer zeroes-in the sight 100 for a particular distance (e.g., 50 yards) and a particular set of shooting parameters (e.g. arrow weight, humidity, and elevation). Due to the particular shooting parameter and/or variability in the sight 100, in the illustrated example the primary pointer 140 is aligned with indicia 51 on the primary scale 144, rather than the indicia 50 corresponding to the actual distance for which the bow is sighted in. To correct this variability, the archer rotates the knob 132 so the micro-pointer 124 moves downward from the zero marker 150 to the negative one indicia 152. The primary pointer 140 simultaneously moves from the indicia 51 on the primary scale 144 to the indicia 50. In this configuration, the primary pointer 140 informs the archer that the bow is sighted in for yardage corresponding to indicia 50 yards for the current shooting parameters. The micro-pointer 124 also informs the archer that the shooting parameters resulted in variability between how the sight 100 is actually configured and the location of the primary pointer 140.

As shooting parameters change, the micro-pointer 124 can be adjusted to reflect the new parameters. For example, if the archer switches to a lower weight arrow the current configuration of the sight 100 will result in the arrow traveling more than the distance corresponding to the indicia 50. Assuming the archer previously determined that the particular lighter arrow travels a certain distance further than the current weight arrow, the micro-pointer to indicia 52 to reflect the actual yardage the arrow will travel.

In an alternate embodiment, the micro-scale 128 may be calibrated for one or more of the shooting parameters other than yardage to the target. For example, the indicia 150, 152, 154 may be an indication of changes in arrow weight. For example, each indicia 150, 152, 154 may correspond to a 10 or 15 grain increase or decrease in arrow weight. The indicia 150, 152, 154 may also provide an adjustment for shooting angle (uphill or downhill).

Figure 4:
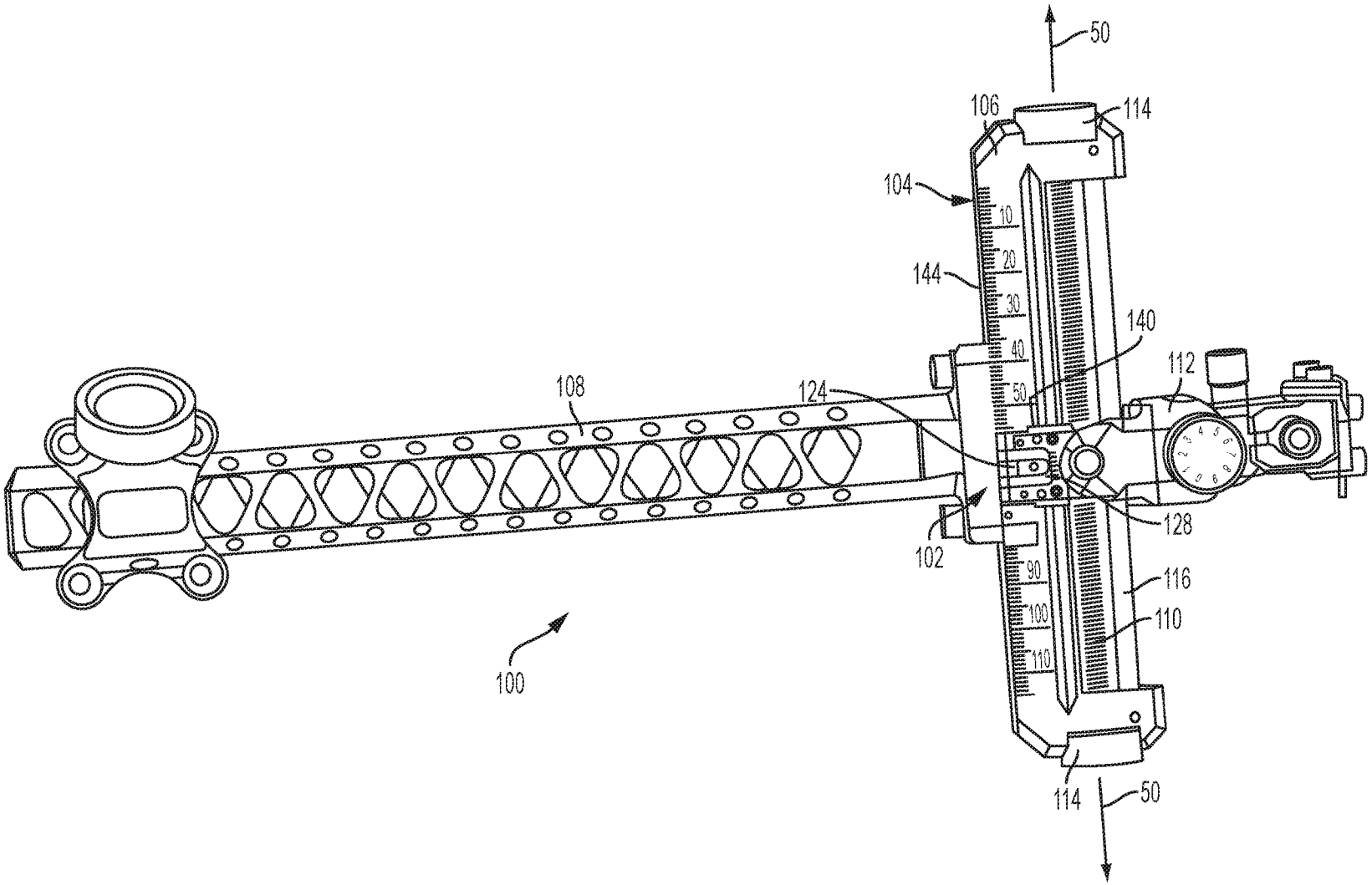
FIG. 4 is a perspective view of a micro-pointer system on an archery sight in accordance with an embodiment of the present disclosure.
Figure 5:
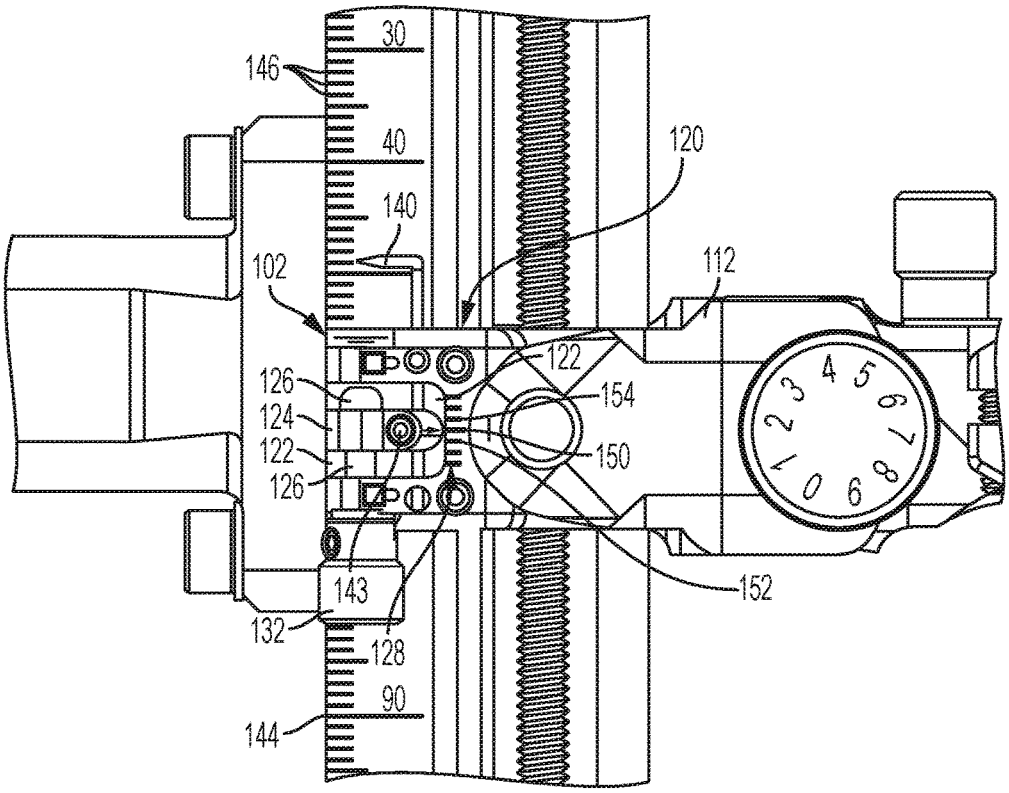
FIG. 5 is an enlarged view of the micro-pointer system of FIG. 4.
Figure 7:
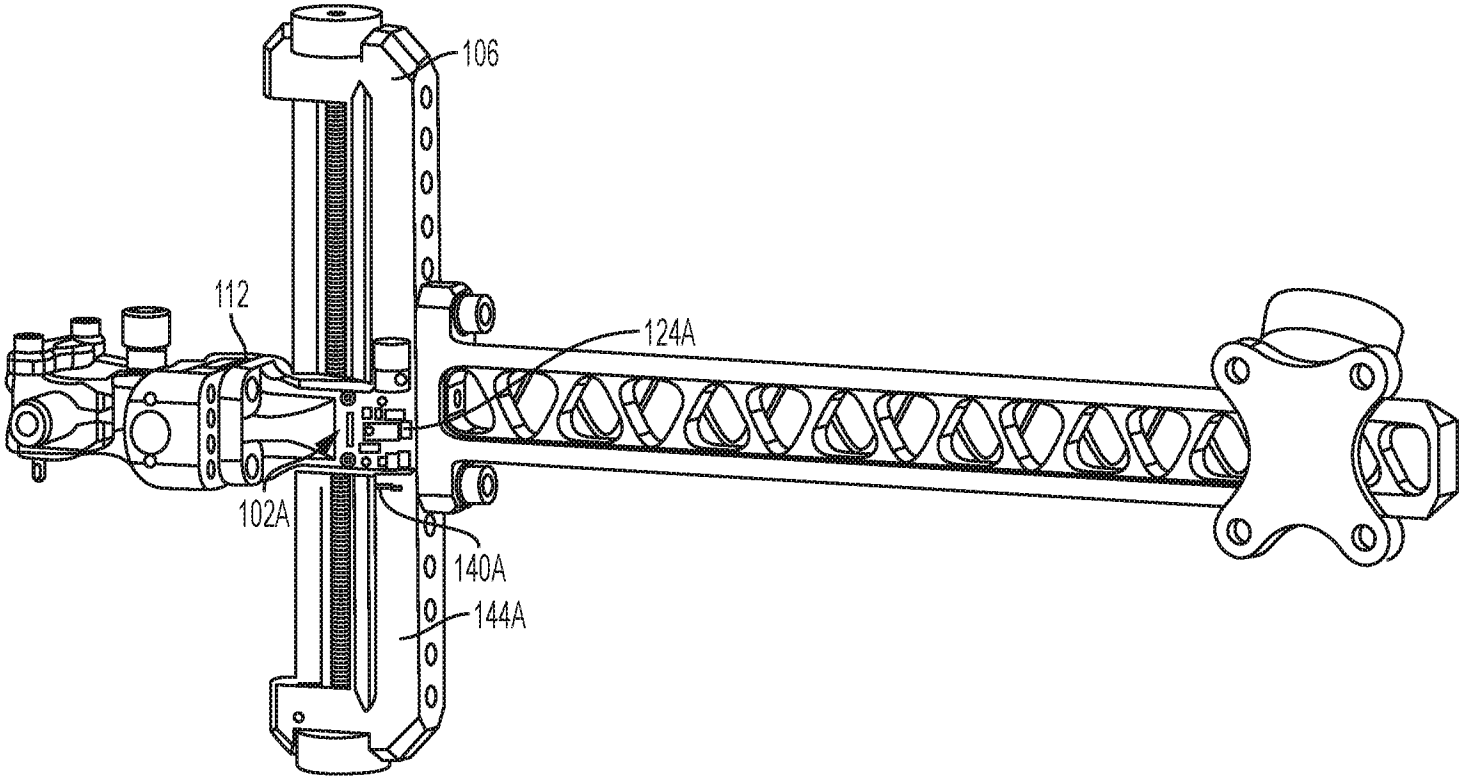
FIG. 7 is a perspective view of a second micro-pointer system located on the opposite side of the archery sight of FIG. 4 in accordance with an embodiment of the present disclosure.

FIG. 7 is a perspective view of a second micro-pointer system 102A located on the opposite side of the archery sight of FIG. 4 in accordance with an embodiment of the present disclosure. Micro-pointer system 102A is attached to the opposite side of the bezel mount 112. Primary pointer 140A is attached to the micro-pointer 124A as discuss herein. In the illustrated embodiment, primary scale 144A on the elevation block 106 is blank so the archer can attached a scale with custom indicia.

Figure 8:
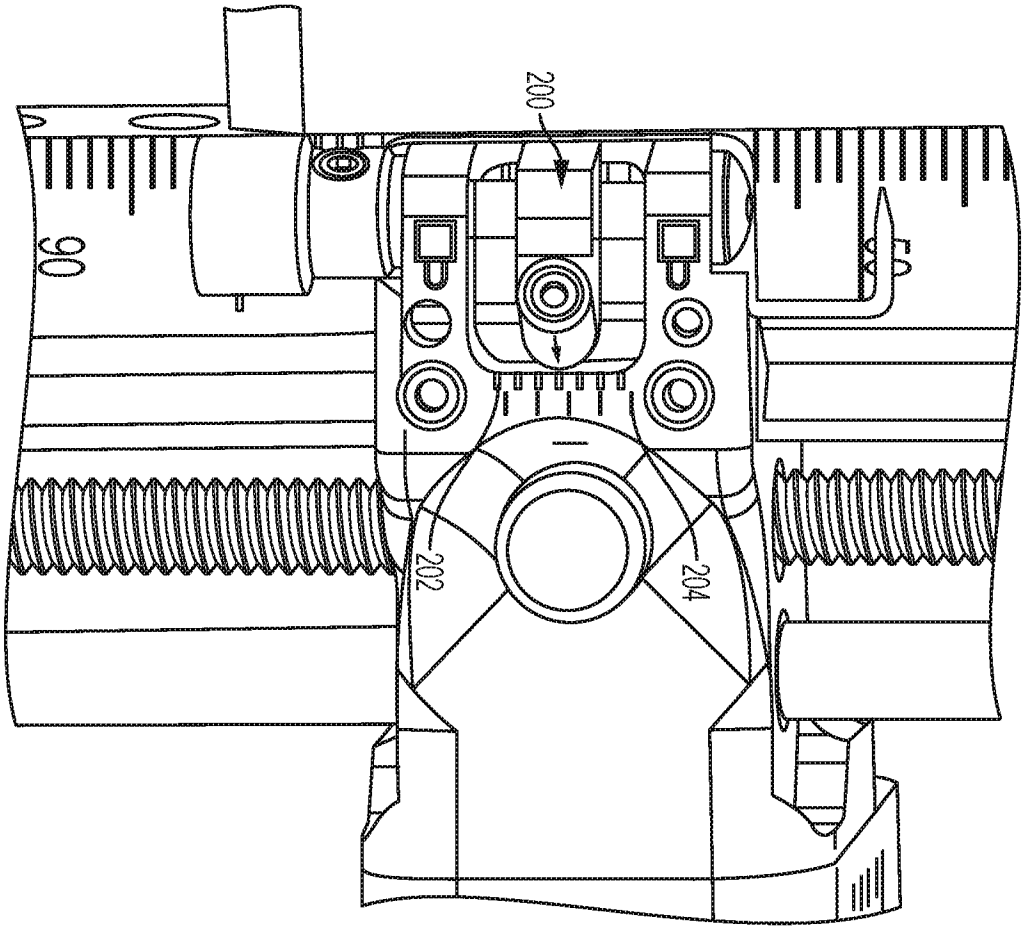
FIG. 8 illustrate an alternate micro-pointer system with two micro-scales in accordance with an embodiment of the present disclosure.

FIG. 8 illustrates an alternate micro-pointer system 200 with two micro-scales 202, 204, each one corresponding to a different shooting parameter (e.g., distance to target, arrow weight, shooting angle, etc.). For example, the micro-scale 202 is calibrated for distance to the target and the micro-scale 204 is calibrated for shooting angle.

Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

The invention claimed is:

1. A pointer system for an archery sight comprising:

a mounting arm configured to attach to a bow;

an elevation assembly attached to the mounting arm, the elevation assembly comprising an elevation adjustment mechanism that moves a bezel mount along a generally vertical axis relative to the mounting arm;

a bezel attached to the bezel mount, the bezel including at least one sighting device to sight the bow at a target;

a micro-pointer system attached to the bezel mount that travels with the bezel mount along the vertical axis, the micro-pointer system comprising a micro-adjust mechanism configured to move a micro-pointer parallel to the vertical axis relative to a micro-scale on the bezel mount; and a primary pointer system comprising a primary pointer attached to the micro-pointer providing an indication of an elevation setting of the elevation assembly relative to the mounting arm along a primary scale located on the elevation adjustment mechanism, wherein adjustment of the micro-adjust mechanism simultaneously moves the primary pointer relative to the primary scale and the micro-pointer relative to the micro-scale.

2. The pointer system for an archery sight of claim 1, wherein the micro-adjust mechanism repeatably displaces the micro-pointer in increments of about 0.05 inches.

3. The pointer system for an archery sight of claim 1, wherein the micro-adjust mechanism repeatably displaces the micro-pointer in increments of about 0.025 inches.

4. The pointer system for an archery sight of claim 1, wherein the micro-adjust mechanism comprises a micro-adjust lead screw that spans a recess in the bezel mount, with the micro-pointer located within the recess.

5. The pointer system for an archery sight of claim 4, wherein a 360 degree rotation of the micro-adjust lead screw comprises a linear translation of the micro-pointer and the primary pointer of about 0.025 inches along the vertical axis.

6. The pointer system for an archery sight of claim 1, wherein indicia on the micro-scale comprises the same units of measure as indicia on the primary scale.

7. The pointer system for an archery sight of claim 1, wherein indicia on the micro-scale comprise an indication of an adjustment required for a shooting parameter other than distance to the target.

8. The pointer system for an archery sight of claim 1, wherein indicia on the micro-scale comprise an indication of an adjustment required for different arrow weights.

9. The pointer system for an archery sight of claim 1, wherein indicia on the micro-scale comprise an indication of an adjustment required for different shooting angles.

10. The pointer system for an archery sight of claim 1, comprising a set screw releasably securing the primary pointer to the micro-pointer.

11. The pointer system for an archery sight of claim 1, wherein release of a set screw permits the primary pointer to slide along the vertical axis relative to the micro-pointer.

12. A pointer system for an archery sight comprising:

a mounting arm configured to attach to a bow;

an elevation assembly attached to the mounting arm, the elevation assembly comprising an elevation block with an elevation lead screw engaged with a threaded bezel mount to move the bezel mount along a generally vertical axis relative to the mounting arm in response to rotation of the elevation lead screw;

a bezel attached to the bezel mount, the bezel including at least one sighting device to sight the bow at a target;

a micro-pointer system attached to the bezel mount that travels with the bezel mount along the vertical axis in response to rotation of the elevation lead screw, the micro-pointer system comprising a micro-adjust lead screw configured to move a threaded micro-pointer parallel to the vertical axis relative to a micro-scale on the bezel mount in response to rotation of the micro-adjust lead screw; and a primary pointer system comprising a primary pointer attached to the micro-pointer providing an indication of an elevation setting of the elevation assembly relative to the mounting arm along a primary scale located on the elevation block, wherein rotation of the micro-adjust lead screw simultaneously moves the primary pointer relative to the primary scale and the micro-pointer relative to the micro-scale.

13. A method of operating a pointer system on an archery sight that is mounted to a bow, the method comprising the steps of:

providing a micro-pointer system attached to a bezel mount that travels with the bezel mount along a vertical axis in response to adjustment of an elevation adjustment mechanism relative to the bow, the micro-pointer system comprising a micro-adjust mechanism configured to move a micro-pointer parallel to the vertical axis relative to a micro-scale on the bezel mount;

providing a primary pointer system comprising a primary pointer attached to the micro-pointer providing an indication of an elevation setting of the elevation assembly relative to the bow along a primary scale located on the archery sight, wherein adjustment of the micro-adjust mechanism simultaneously moves the primary pointer relative to the primary scale and the micro-pointer relative to the micro-scale;

adjusting a vertical position of a sighting device attached to the bezel mount relative to the vertical axis so an arrow fired from the bow strikes a target located at a first distance from the archer at a location indicated by the sighting device; and displacing the micro-pointer using the micro-adjust mechanism so the primary pointer is aligned with an indicia on the primary scale corresponding to the first distance.

14. A method of operating a pointer system on an archery sight that is mounted to a bow, the method comprising the steps of:

providing a micro-pointer system attached to a bezel mount that travels with the bezel mount along a vertical axis in response to rotation of an elevation lead screw relative to an elevation block of an elevation assembly, the micro-pointer system comprising a micro-adjust lead screw configured to move a threaded micro-pointer parallel to the vertical axis relative to a micro-scale on the bezel mount in response to rotation of the micro-adjust lead screw;

providing a primary pointer system comprising a primary pointer attached to the micro-pointer providing an indication of an elevation setting of the elevation assembly relative to the bow along a primary scale located on the elevation block, wherein rotation of the micro-adjust lead screw simultaneously moves the primary pointer relative to the primary scale and the micro-pointer relative to the micro-scale;

adjusting a vertical position of a sighting device attached to the bezel mount relative to the vertical axis so an arrow fired from the bow strikes a target located at a first distance from the archer at a location indicated by the sighting device; and rotating the micro-adjust lead screw so the primary pointer is aligned with an indicia on the primary scale corresponding to the first distance.

15. The method of claim 14, further comprising rotating the micro-lead screw about 360 degrees to translate the micro-pointer and the primary pointer about 0.025 inches along the vertical axis.

16. The method of claim 14, wherein indicia on the micro-scale comprises a same units of measure as indicia on the primary scale.

17. The method of claim 14, further comprising:

changing a shooting parameter; and rotating the micro-adjust lead screw an amount so the micro-pointer is aligned with indicia on the micro-scale corresponding to the changed shooting parameter, wherein the primary pointer provides an indication of distance of arrow travel for the changed shooting parameter.

18. The method of claim 14, wherein the primary pointer comprises an indication of distance of arrow flight for an arrow having a weight indicated by the micro-pointer relative to the micro-scale.

19. The method of claim 14, wherein the primary pointer comprises an indication of distance of arrow flight for a shooting angle indicated by the micro-pointer relative to the micro-scale.

* * * * *